US009129500B2

(12) United States Patent
Tenenbaum et al.

(10) Patent No.: US 9,129,500 B2
(45) Date of Patent: Sep. 8, 2015

(54) APPARATUS FOR MONITORING THE CONDITION OF AN OPERATOR AND RELATED SYSTEM AND METHOD

(75) Inventors: Carl N. Tenenbaum, North Andover, MA (US); Julie N. Strickland, Dallas, TX (US); Jeffrey H. Saunders, Andover, MA (US); Andrew M. Wilds, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 234 days.

(21) Appl. No.: 13/609,487

(22) Filed: Sep. 11, 2012

(65) Prior Publication Data

US 2014/0072136 A1 Mar. 13, 2014

(51) Int. Cl.

| | |
|---|---|
| ***H04R 1/10*** | (2006.01) |
| ***H04R 5/02*** | (2006.01) |
| ***G08B 21/02*** | (2006.01) |
| ***G08B 21/06*** | (2006.01) |

(52) U.S. Cl.

CPC ..... *G08B 21/02* (2013.01); *G08B 21/06* (2013.01)

(58) Field of Classification Search

None

See application file for complete search history.

(56) References Cited

U.S. PATENT DOCUMENTS

| | | | | |
|---|---|---|---|---|
| 6,876,964 | B1 | 4/2005 | Shiomi et al. | |
| 2011/0010172 | A1* | 1/2011 | Konchitsky | 704/233 |
| 2011/0106627 | A1* | 5/2011 | LeBoeuf et al. | 705/14.66 |
| 2011/0113330 | A1* | 5/2011 | Olsson et al. | 715/716 |
| 2011/0269411 | A1* | 11/2011 | Yamkovoy et al. | 455/78 |
| 2012/0194549 | A1 | 8/2012 | Osterhout et al. | |
| 2012/0244812 | A1* | 9/2012 | Rosener | 455/41.3 |

FOREIGN PATENT DOCUMENTS

EP 1 046 411 A2 10/2000

OTHER PUBLICATIONS

"Freer Logic, improving human performance," Freer Logic, 5 pages, Copyright 2001.

"The Nap Zapper Alarm Can Save Lives," The Nap Zapper Saves Lives, 3 pages.

Highway Safety Group, DD850 Driver Fatigue, Lane Management & Warning Systems, 1 page, "DD850 Fatigue Warning System: Making Good Drivers Saver!", 2004-2010.

"A20 Aviation Headset", Bose, Owner's Guide, 44 pages.

* cited by examiner

*Primary Examiner* — Regina N Holder

(57) ABSTRACT

An apparatus includes a headset having one or more speaker units. Each speaker unit is configured to provide audio signals to an operator. Each speaker unit includes an ear cuff configured to contact the operator's head. The headset further includes multiple sensors configured to measure one or more characteristics associated with the operator. At least one of the sensors is embedded within at least one ear cuff of at least one speaker unit. The sensors could include an electrocardiography electrode, a skin conductivity probe, pulse oximetry light emitting diodes and photodetectors, an accelerometer, a gyroscope, or a temperature sensor. The apparatus could also include a processing unit configured to analyze audio signals captured by a microphone unit of the headset to identify respiration by the operator or at least one voice characteristic of the operator.

23 Claims, 9 Drawing Sheets

APPARATUS FOR MONITORING THE CONDITION OF AN OPERATOR AND RELATED SYSTEM AND METHOD

TECHNICAL FIELD

This disclosure is generally directed to operator headsets. More specifically, this disclosure is directed to a headset for monitoring the condition of an operator and a related system and method.

BACKGROUND

In various environments, it may be necessary or desirable for operators to wear communication headsets. For example, air traffic controllers and airplane pilots often wear headsets in order to communicate with one another. As another example, Unmanned Aerial Vehicle (UAV) operators and air defense system operators often wear headsets in order to communicate with others or listen to information. These types of environments are often highly taxing on an operator. Drowsiness, inattention, stress, or fatigue can cause loss of life or millions of dollars in property damage.

Various approaches have been developed to identify problems with an operator wearing a headset. For example, some approaches detect the nodding of an operator's head to identify operator drowsiness or fatigue, while other approaches analyze voice communications to detect operator stress or fatigue. Still other approaches require that an operator wear a blood pressure cuff at all times. These conventional approaches are typically more invasive and uncomfortable to an operator or require the use of additional equipment, such as motion sensors or optical sensors.

SUMMARY

This disclosure provides a headset for monitoring the condition of an operator and a related system and method.

In a first embodiment, an apparatus includes a headset having one or more speaker units. Each speaker unit is configured to provide audio signals to an operator. Each speaker unit includes an ear cuff configured to contact the operator's head. The headset further includes multiple sensors configured to measure one or more characteristics associated with the operator. At least one of the sensors is embedded within at least one ear cuff of at least one speaker unit.

In a second embodiment, a system includes a headset and at least one processing unit. The headset includes one or more speaker units. Each speaker unit is configured to provide audio signals to an operator. Each speaker unit includes an ear cuff configured to contact the operator's head. The headset also includes multiple sensors configured to measure one or more characteristics associated with the operator. At least one of the sensors is embedded within at least one ear cuff of at least one speaker unit. The at least one processing unit is configured to analyze measurements of the one or more characteristics to identify a measure of operator awareness associated with the operator.

In a third embodiment, a method includes providing audio signals to an operator using one or more speaker units of a headset. Each speaker unit includes an ear cuff configured to contact the operator's head. The method also includes measuring one or more characteristics associated with the operator using multiple sensors. At least one of the sensors is embedded within at least one ear cuff of at least one speaker unit.

In a fourth embodiment, an apparatus includes a cover configured to be placed over at least a portion of a speaker unit of a headset. The cover includes at least one sensor configured to measure one or more characteristics associated with the operator. The at least one sensor is embedded within the cover.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 11, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

This disclosure provides various headsets that can be worn by operators. Each headset includes sensors that measure various physiological characteristics of an operator, such as the operator's head tilt, pulse rate, pulse oximetry, and skin temperature. Voice characteristics of the operator can also be measured. This data is then analyzed to determine the "operator awareness" of the operator. Operator awareness refers to a measure of the condition of the operator, such as whether the operator is suffering from drowsiness, inattention, stress, or fatigue. If necessary, corrective action can be initiated when poor operator awareness is detected, such as notifying other personnel or providing feedback to the operator.

Figure 1:
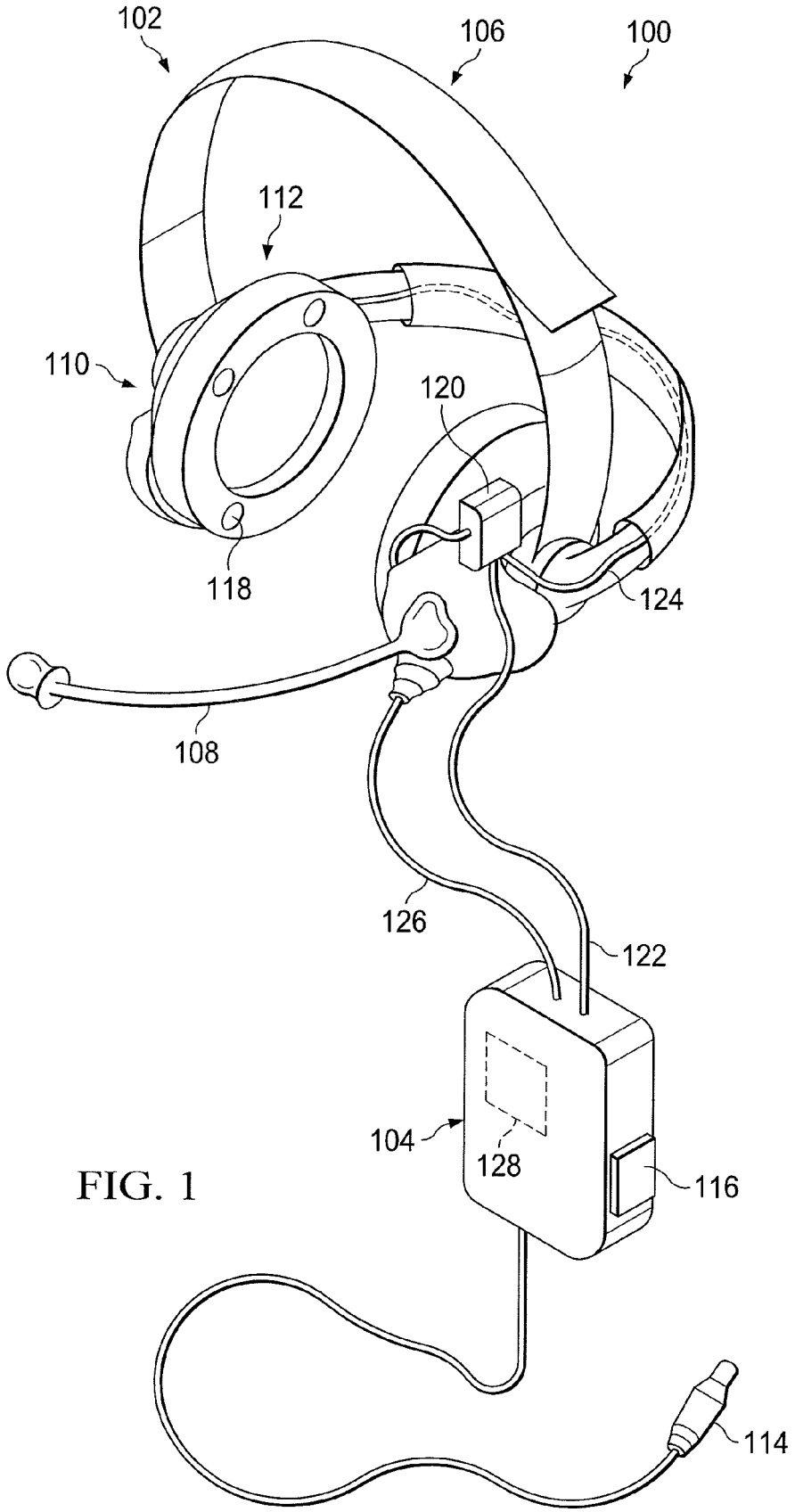
FIGS. 1 through 3 illustrate example systems for monitoring the condition of an operator in accordance with this disclosure.
Figure 2:
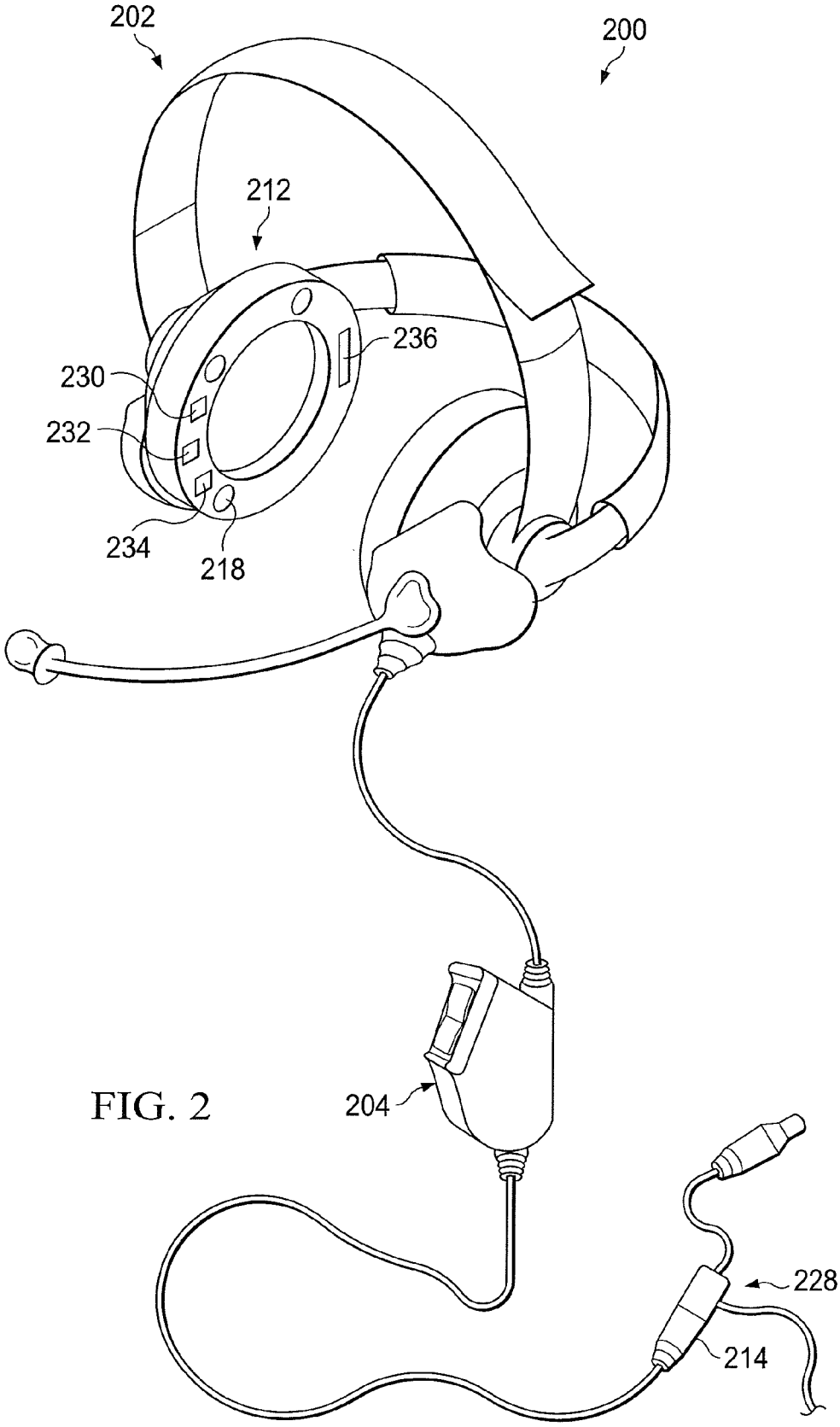
Figure 3:
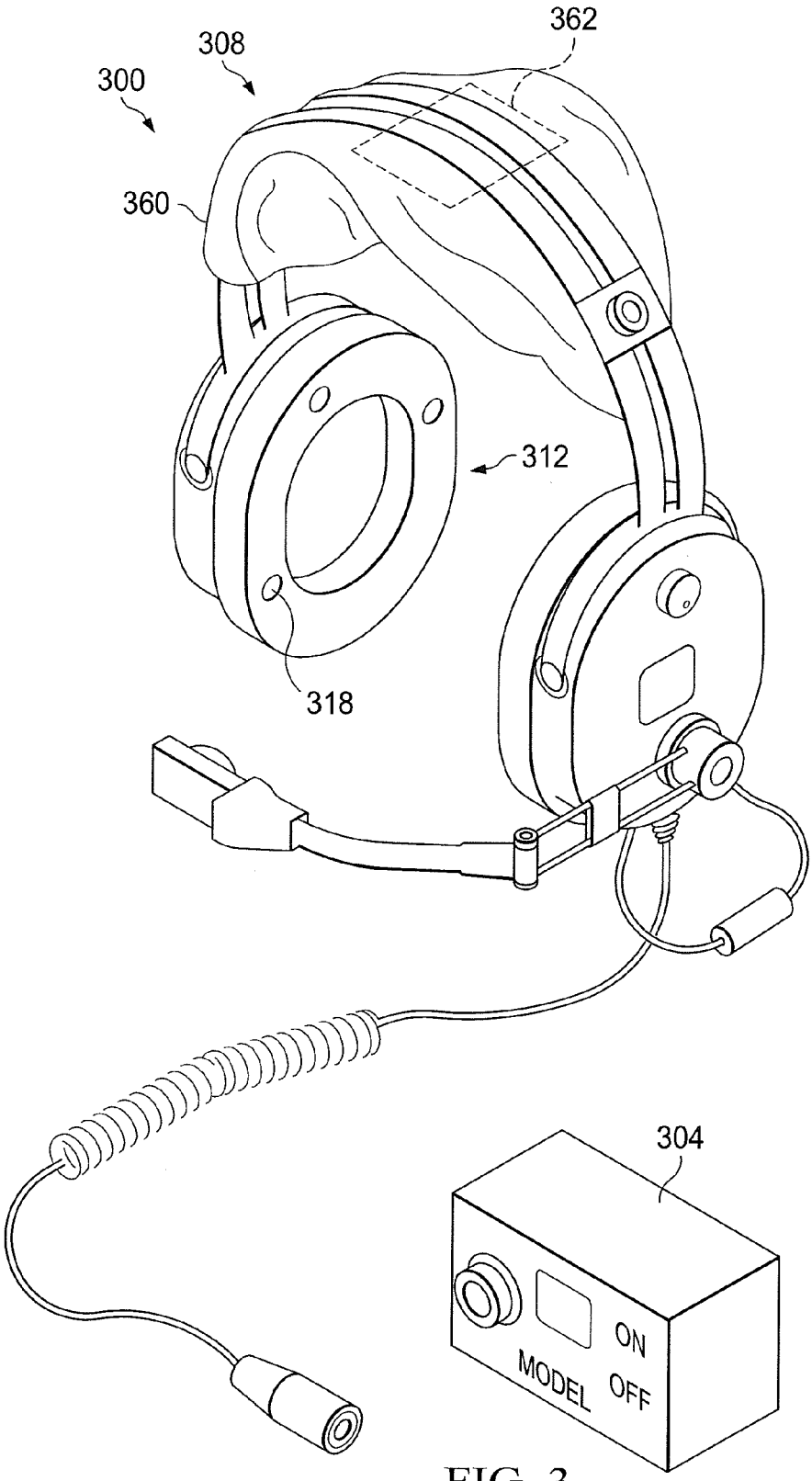

FIGS. 1 through 3 illustrate example systems for monitoring the condition of an operator in accordance with this disclosure. As shown in FIG. 1, a system 100 includes two main components, namely a headset 102 and a control unit 104. The headset 102 generally represents the portion of the system 100 worn on the head of an operator. The control unit 104 generally represents the portion of the system 100 held in the hand of or otherwise used by an operator. The control unit 104 typically includes one or more user controls for controlling the operation of the headset 102. For example, the control unit 104 could represent a "push-to-talk" unit having a button, where depression of the button causes the system 100 to transmit outgoing audio data to an external destination.

In this example embodiment, the headset 102 includes a head strap 106, which helps secure the headset 102 to an operator's head. The headset 102 also includes a microphone unit 108, which captures audio information (such as spoken words) from the operator. The headset 102 further includes two speaker units 110, which provide audio information (such as another person's spoken words) to the operator. The head strap 106 includes any suitable structure for securing a headset to an operator. In this example, the head strap 106 includes a first portion that loops over the top of an operator's head and a second portion that loops over the back of the operator's head. The microphone unit 108 includes any suitable structure for capturing audio information. Each speaker unit 110 includes any suitable structure for presenting audio information.

As shown here, each speaker unit 110 includes an ear cuff 112. The ear cuffs 112 generally denote compressible or other structures that contact an operator's head and are placed around an operator's ears. This can serve various purposes, such as providing comfort to the operator or helping to block ambient noise. Note that other techniques could also be used to help block ambient noise, such as active noise reduction. Each ear cuff 112 could have any suitable size and shape, and each ear cuff 112 could be formed from any suitable material (s), such as foam. Each ear cuff 112 could also be waterproof to protect integrated components within the ear cuff 112.

The control unit 104 here includes one or more controls. The controls could allow the operator to adjust any suitable operational characteristics of the system 100. For example, as noted above, the controls could include a "push-to-talk" button that causes the system 100 to transmit audio information captured by the microphone unit 108. The control unit 104 could also include volume controls allowing the operator to adjust the volume of the speaker units 110. Any other or additional controls could be provided on the control unit 104.

The control unit 104 also includes a connector 114 that allows the control unit 104 to be electrically connected to an external device or system. The connector 114 allows for the exchange of any suitable information. For example, the connector 114 could allow the control unit 104 to provide outgoing audio information from the microphone unit 108 to the external device or system via the connector 114. The connector 114 could also allow the control unit 104 to receive incoming audio information from the external device or system via the connector 114 and provide the incoming audio information to the speaker units 110. The connector 114 includes any suitable structure facilitating wired communication with an external device or system. The control unit 104 also includes a data connector 116, such as an RJ-45 jack. The data connector 116 could be used to exchange operator awareness information with an external device or system. Note that the use of wired communications is not required, and the control unit 104 and/or the headset 102 could include at least one wireless transceiver for communicating with external devices or systems wirelessly.

As shown in FIG. 1, the headset 102 includes multiple sensors 118. The sensors 118 here are shown as being embedded within the ear cuffs 112 of the headset 102, although various sensors 118 could be located elsewhere in the headset 102. The sensors 118 measure various characteristics of the operator or the operator's environment. Example sensors are described below. Each sensor 118 includes any suitable structure for measuring at least one characteristic of an operator or the operator's environment.

Data from the sensors 118 is provided to processing circuitry 120. The processing circuitry 120 performs various operations using the sensor data. For example, the processing circuitry 120 could include one or more analog-to-digital converters (ADCs) that convert analog sensor data from one or more sensors into digital sensor data. The processing circuitry 120 could also include one or more digital signal processors (DSPs) or other processing devices that analyze the sensor data, such as by sampling the digital sensor data to select appropriate sensor measurements for further use. The processing circuitry 120 could further include one or more digital interfaces that allow the processing circuitry 120 to communicate with the control unit 104 over a digital bus 122. The processing circuitry 120 could include any other or additional components for handling sensor data.

One or more wires 124 in this example couple various sensors 118 and the processing circuitry 120. Note, however, that wireless communications could also occur between the sensors 118 and the processing circuitry 120. The headset 102 is also coupled to the control unit 104 via one or more wires 126, which could transport audio data between the headset 102 and the control unit 104. Once again, note that wireless communications could occur between the headset 102 and control unit 104.

In this example, the control unit 104 includes a processing unit 128. The processing unit 128 analyzes data from the processing circuitry 120 to determine a measure of the operator's awareness. The processing unit 128 could also analyze other data, such as audio data captured by the microphone unit 108. Any suitable analysis algorithm(s) could be used by the processing unit 128. For example, the processing unit 128 could perform data fusion of multiple sets of biometric sensor data, along with voice characterization.

If the processing unit 128 determines that the operator is drowsy (or asleep), inattentive, fatigued, stressed, or otherwise has low operator awareness, the processing unit 128 could take any suitable corrective action. This could include, for example, triggering some type of biofeedback mechanism, such as a motor or other vibrating device in the headset 102 or an audible noise presented through the speaker units 110. This could also include transmitting an alert to an external device or system, which could cause a warning to be presented on a display screen used by the operator or by other personnel. Any other suitable corrective action(s) could be initiated by the processing unit 128. The processing unit 128 includes any suitable processing or computing structure for determining a measure of an operator's awareness, such as a microprocessor, microcontroller, DSP, field programmable gate array (FPGA), or application specific integrated circuit (ASIC).

Note that in this example, there are separate components for initially processing the data from the sensors 118 (processing circuitry 120) and for determining a measure of operator awareness (processing unit 128). This functional division is for illustration only. In other embodiments, these functions could be combined and performed by a common processing device or other processing system.

FIG. 2 illustrates another example system 200 having a headset 202 and a control unit 204. Sensors 218 are integrated into ear cuffs 212 and possibly other portions of the headset 202. Here, at least one ear cuff 212 also includes an integrated wireless transceiver 230, which can transmit sensor data to other components of the system 200. The wireless transceiver 230 includes any suitable structure supporting wireless communications, such as a BLUETOOTH or other radio frequency (RF) transmitter or transceiver.

At least one ear cuff 212 can also include one or more mechanisms for identifying the specific operator currently using the headset 202. This could include a user biometric identifier 232 or a user identification receiver 234. The user biometric identifier 232 identifies the operator using any suitable biometric data. The user identification receiver 234 identifies the operator using data received from a device associated with the operator, such as a radio frequency identification (RFID) security tag or an operator's smartphone. At least one ear cuff 212 can further include a power supply 236, which can provide operating power to various components of the headset 202. Any suitable power supply 236 could be used, such as a battery or fuel cell.

A connector 214 couples the control unit 204 to an external processing unit 228. The processing unit 228 analyzes sensor or other data to determine a measure of operator awareness. For example, the processing unit 228 could wirelessly communicate with the wireless transceiver 230 to collect data from the sensors 218. The processing unit 228 could also analyze audio data captured by the headset 202. The processing unit 228 could further communicate with any suitable external device or system via suitable communication mechanisms. For instance, the processing unit 228 could include an RJ-45 jack, a conventional commercial headset connection, one or more auxiliary connections, or a Universal Serial Bus (USB) hub (which could also receive power). The processing unit 228 could also communicate over a cloud, mesh, or other wireless network using BLUETOOTH, ZIGBEE, or other wireless protocol(s).

FIG. 3 illustrates yet another example system 300 having a headset 302 and a control unit 304. Sensors 318 are integrated into ear cuffs 312 and possibly other portions of the headset 302. The headset 302 also includes a pad 360, which can be placed against an operator's head when the headset 302 is being worn. Moreover, a circuit board 362 is embedded within or otherwise associated with the pad 360. The circuit board 362 could include components that support various functions, such as operator detection or sensor data collection. One or more sensors could also be placed on the circuit board 362, such as an accelerometer or gyroscope. Any suitable circuit board technology could be used, such as a flexible circuit board.

By using sensors integrated into a headset to collect physiological data associated with an operator, a system can determine a measure of the operator's awareness more precisely, reducing false alarms. Depending on the implementation, the detection rate of operator distress could be better than 90% (possibly better than 99%), with a false alarm rate of less than 5% (possibly less than 0.1%). This can be done affordably and in a non-intrusive manner since this functionality can be easily integrated into existing systems. Moreover, a team can be alerted when an individual team member is having difficulty, and extensive algorithms can be used to analyze an operator's condition.

Note that a wide variety of sensors could be used in a headset to capture information related to an operator. These can include accelerometers or gyroscopes to measure head tilt, heart rate monitors, pulse oximeters such as those using visible and infrared light emitting diodes (LEDs), and electrocardiography (EKG/ECG) sensors such as those using instrumentation amplifiers and right-leg guarding (RLD). These can also include acoustic sensors for measuring respiration and voice characteristics (like latency, pitch, and amplitude), non-contact infrared thermopiles or other temperature sensors, and resistance sensors such as four-point galvanic skin resistance sensors for measuring skin connectivity. These can further include cuff-less blood pressure monitors and hydration sensors. Other sensors, like Global Positioning System (GPS) sensors and microphones for measuring background noise, could be used to collect information about an operator's environment. In addition, various other features could be incorporated into a headset as needed or desired, such as encryption functions for wireless communications.

Although FIGS. 1 through 3 illustrate examples of systems for monitoring the condition of an operator, various changes may be made to FIGS. 1 through 3. For example, FIGS. 1 through 3 illustrate several examples of how headsets can be used for monitoring operator awareness. Various features of these systems, such as the location of the data processing, can be altered according to particular needs. As a specific example, the processing of sensor data to measure operator awareness could be done on an external device or system, such as by a computing terminal used by an operator. Also, any combination of the features in these figures could be used, such as when a feature shown in one or more of these figures is used in others of these figures. Further, while described as having multiple speaker units, a headset could include a single speaker unit that provides audio signals to one ear of an operator. In addition, note that the microphone units could be omitted from the headsets, such as when the capture of audio information from an operator is not required.

Figure 4:
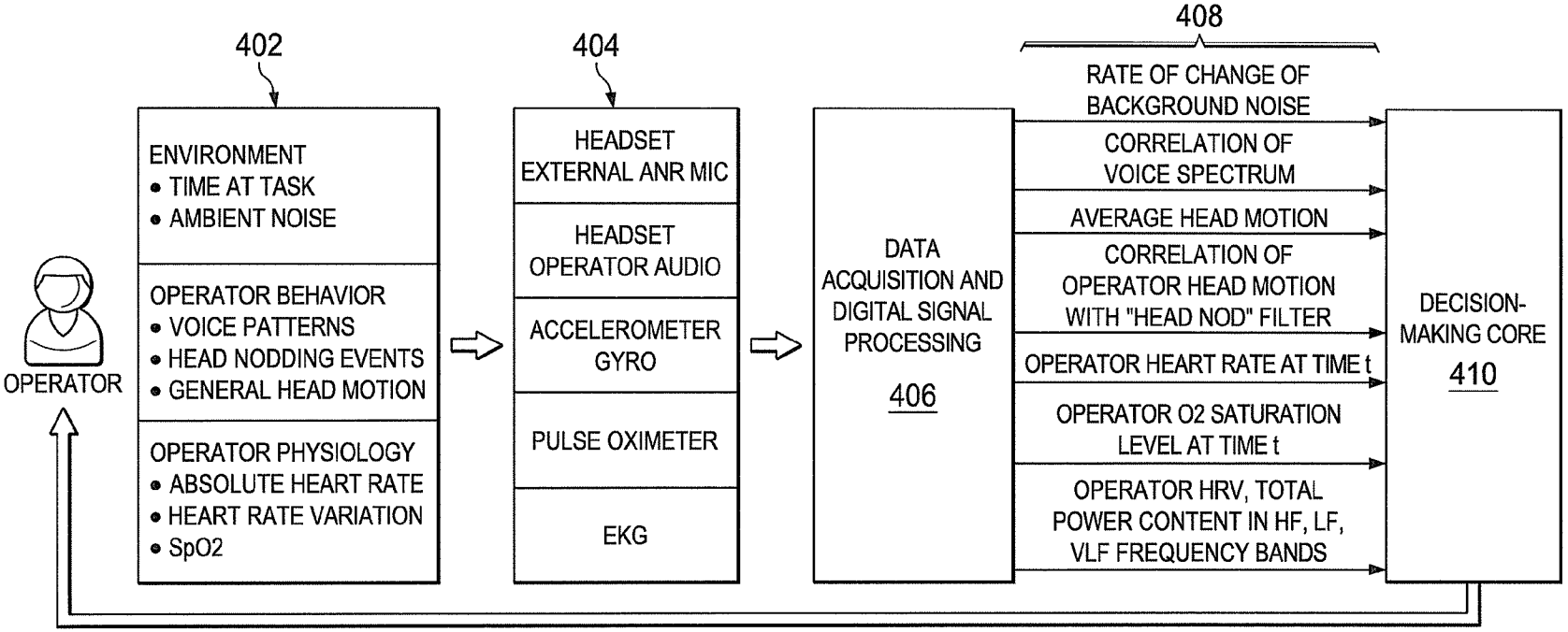
FIGS. 4 and 5 illustrate example functional data flows for monitoring the condition of an operator in accordance with this disclosure.
Figure 5:
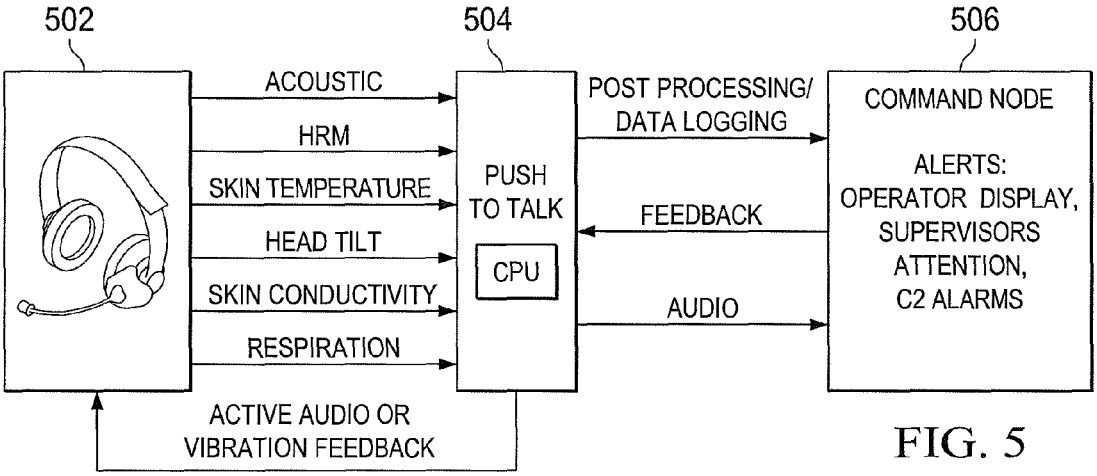

FIGS. 4 and 5 illustrate example functional data flows for monitoring the condition of an operator in accordance with this disclosure. As shown in FIG. 4, the general operation of a system for monitoring the condition of an operator is shown. The system could represent any suitable system, such as one of the systems shown in FIGS. 1 through 3.

As can be seen in FIG. 4, an operator is associated with various characteristics 402. These characteristics 402 include environmental characteristics, such as the length of time that the operator has been working in a current work shift and the amount of ambient noise around the operator. The characteristics 402 also include behavioral characteristics of the operator, such as the operator's voice patterns and head movements like "nodding" events (where the operator's head moves down and jerks back up) and general head motion. The characteristics 402 further include physiological characteristics of the operator, such as heart rate, heart rate variation, and saturation of hemoglobin with oxygen ($SpO_2$) level.

Systems such as those described above use various devices 404 to capture information about the characteristics of the operator. These devices 404 can include an active noise reduction (ANR) microphone or other devices that capture audio information, such as words or other sounds emitted by the operator or ambient noise. These devices 404 also include sensors such as gyroscopes, accelerometers, pulse oximeters, and EKG/ECG sensors.

Data from these devices 404 can undergo acquisition and digital signal processing 406. The processing 406 analyzes the data to identify various captured characteristics 408 associated with the operator or his/her environment. The captured characteristics 408 can include the rate of change in background noise, a correlation of the operator's voice spectrum, and average operator head motion. The captured characteristics 408 can also include a correlation of the operator's head motion with head "nods" and heart rate and oxygen saturation level at a given time. In addition, the characteristics 408 can include heart rate variations, including content in various frequency bands (such as very low, low, and high frequency bands).

These captured characteristics 408 are provided to a decision-making engine 410, which could be implemented using a processing unit or in any other suitable manner. The decision-making engine 410 can perform data fusion or other techniques to analyze the captured characteristics 408 and determine the overall awareness of the operator.

As shown in FIG. 5, a headset 502 provides data to a control unit 504. The data includes acoustic information and physiological information about an operator. The physiological information includes heart rate monitor (HRM), skin temperature, head tilt, skin conductivity, and respiration information. The data also includes acoustic information, such as information related to the operator's voice. The control unit 504 exchanges audio information with a command node 506, which could represent a collection of devices used by multiple personnel.

A central processing unit (CPU) or other processing device in the control unit 504 analyzes the data to identify the operator's awareness. If a problem is detected, the control unit 504 provides biofeedback to the operator, such as audio or vibration feedback. The control unit 504 can also provide data to the command node 506 for logging or further processing. Based on the further processing, the command node 506 could provide feedback to the control unit 504, which the control unit 504 could provide to the operator. In response to a detected problem with an operator, the command node 506 could generate alerts on the operator's display as well as on his or her supervisor's display, generate alarms, or take other suitable action(s).

Although FIGS. 4 and 5 illustrate examples of functional data flows for monitoring the condition of an operator, various changes may be made to FIGS. 4 and 5. For example, the specific combinations of sensors and characteristics used during the monitoring of an operator are for illustration only. Other or additional types of sensors could be used in any desired combination, and other or additional types of characteristics could be measured or identified in any desired combination.

FIGS. 6 through 9 illustrate example components in a system for monitoring the condition of an operator in accordance with this disclosure. Note that FIGS. 6 through 9 illustrate specific implementations of various components in a system for monitoring the condition of an operator. Other systems could include other components implemented in any other suitable manner.

Figure 6:
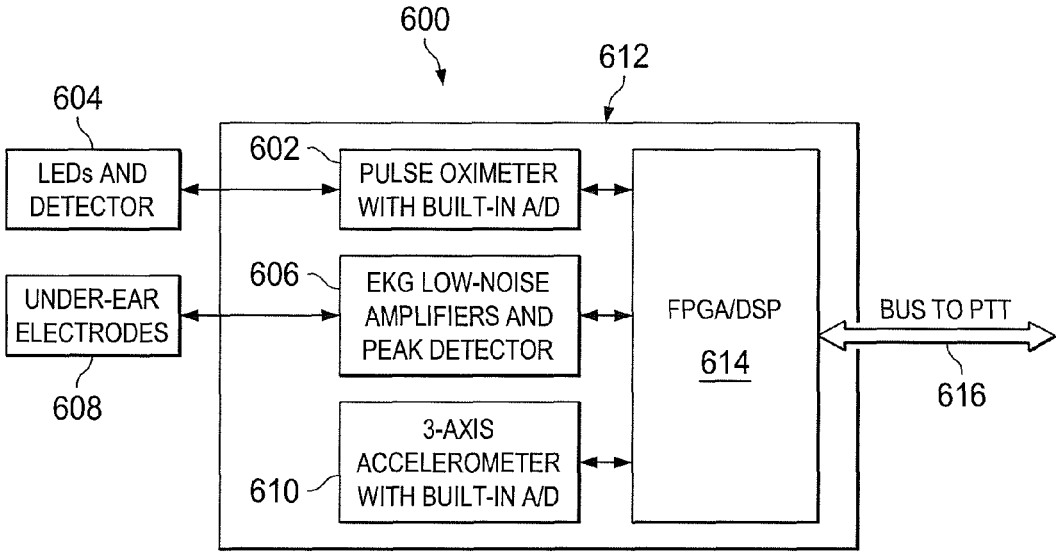
FIGS. 6 through 9 illustrate example components in a system for monitoring the condition of an operator in accordance with this disclosure.

FIG. 6 illustrates example processing circuitry 600 in a headset. The processing circuitry 600 could, for example, represent the processing circuitry 120 described above. As shown in FIG. 6, the processing circuitry 600 includes a pulse oximeter 602, which in this example includes an integral analog-to-digital converter. The pulse oximeter 602 is coupled to multiple LEDs and a photodetector 604. The LEDs generate light at any suitable wavelengths, such as about 650 nm and about 940 nm. The photodetector measures light from the LEDs that has interacted with an operator's skin. The pulse oximeter 602 uses measurements from the photodetector to determine the operator's saturation of hemoglobin with oxygen level.

The processing circuitry 600 also includes EKG/ECG low-noise amplifiers and a peak detector 606, which are coupled to electrodes 608. The electrodes 608 could be positioned in lower portions of the ear cuffs of a headset so that the electrodes 608 are at or near the bottom of the operator's ears when the headset is worn. The EKG/ECG low-noise amplifiers amplify signals from the electrodes, and the peak detector identifies peaks in the amplified signals. In particular embodiments, the EKG/ECG low-noise amplifiers and peak detector 606 could be implemented using various instrumentation amplifiers.

The processing circuitry 600 further includes a two-axis or three-axis accelerometer 610, which in this example includes an integral analog-to-digital converter. The accelerometer 610 measures acceleration (and therefore movement) in different axes. The accelerometer 610 may require no external connections and could be placed on a circuit board 612 or other structure within a headset. In particular embodiments, the accelerometer 610 could be implemented using a microelectromechanical system (MEMS) device.

A processing unit 614, such as an FPGA or DSP, captures data collected by the components 602, 606, 610. For example, the processing unit 614 could obtain samples of the values output by the components 602, 606, 610, perform desired pre-processing of the samples, and communicate the processed samples over a data bus 616 to a push-to-talk (PTT) or other control unit.

Figure 7:
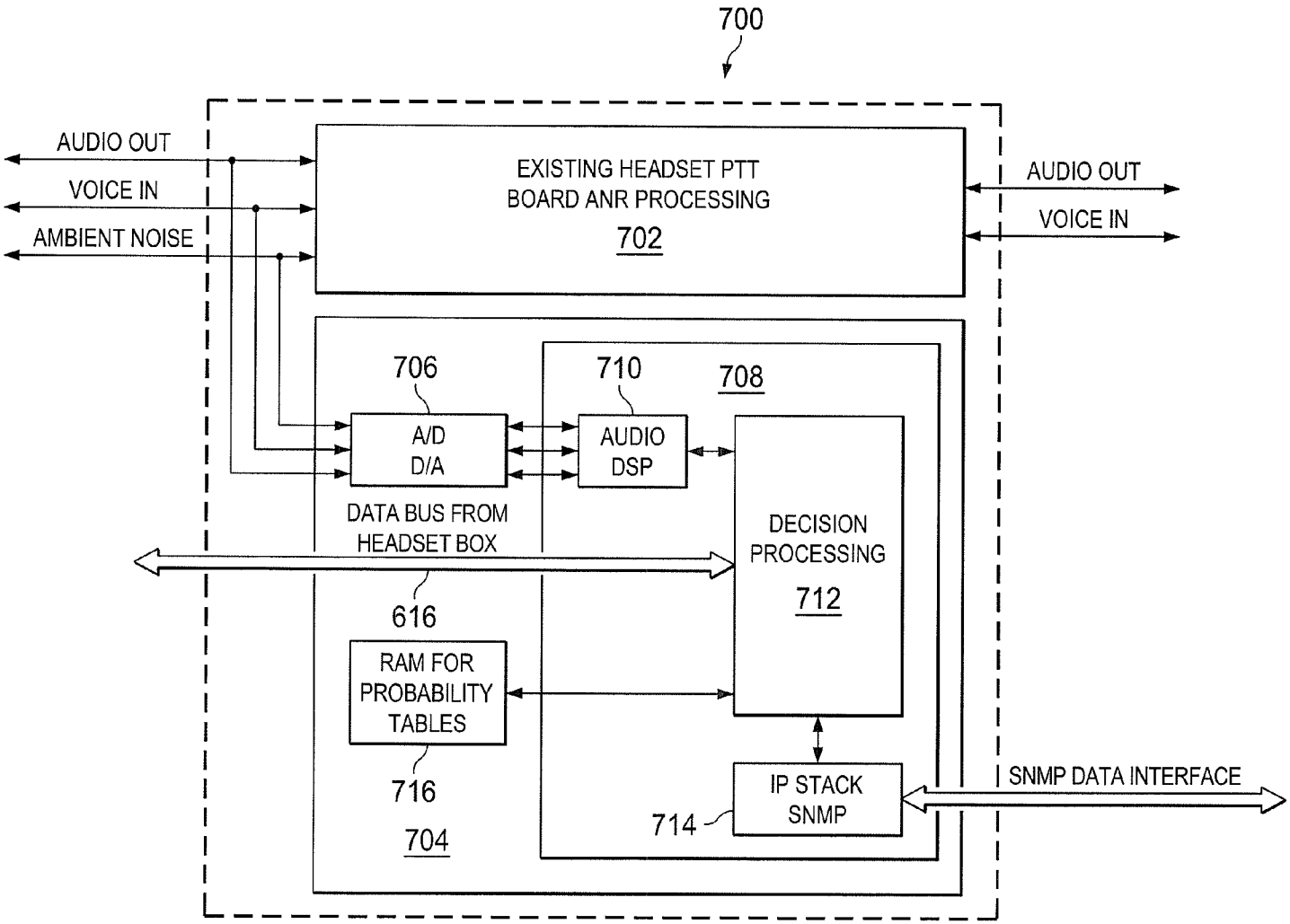

FIG. 7 illustrates an example control unit 700 for use with a headset. The control unit 700 could, for example, represent any of the control units 104, 204, 304, 504 described above. As shown in FIG. 7, the control unit 700 includes a circuit board 702 supporting various standard functions related to a headset. For example, the circuit board 702 could support push-to-talk functions, active noise reduction functions, and audio pass-through. Any other or additional functions could be supported by the circuit board 702 depending on the implementation.

A second circuit board 704 supports monitoring the awareness of an operator. The circuit board 704 receives incoming audio signals in parallel with the circuit board 702 and includes analog-to-digital and digital-to-analog converters 706. These converters 706 can be used, for example, to digitize incoming audio data for voice analysis or to generate audible warnings for an operator. A processing unit 708, such as an FPGA, receives and analyzes data. The data being analyzed can include sensor data received over the bus 616 and voice data from the analog-to-digital converter 706.

In this example, the processing unit 708 includes an audio processor 710 (such as a DSP), a decision processor 712, and an Internet Protocol (IP) stack 714 supporting the Simple Network Management Protocol (SNMP). The audio processor 710 receives digitized audio data and performs various calculations involving the digitized audio data. For example, the audio processor 710 could perform calculations to identify the latency, pitch, and amplitude of the operator's voice. The decision processor 712 analyzes the data from the audio processor 710 and from various sensors in the operator's headset to measure the operator's awareness. The algorithm could use one or more probability tables that are stored in a memory 716 (such as a random access memory or other memory) to identify the condition of an operator. The IP stack 714 facilitates communication via an SNMP data interface.

Figure 8:
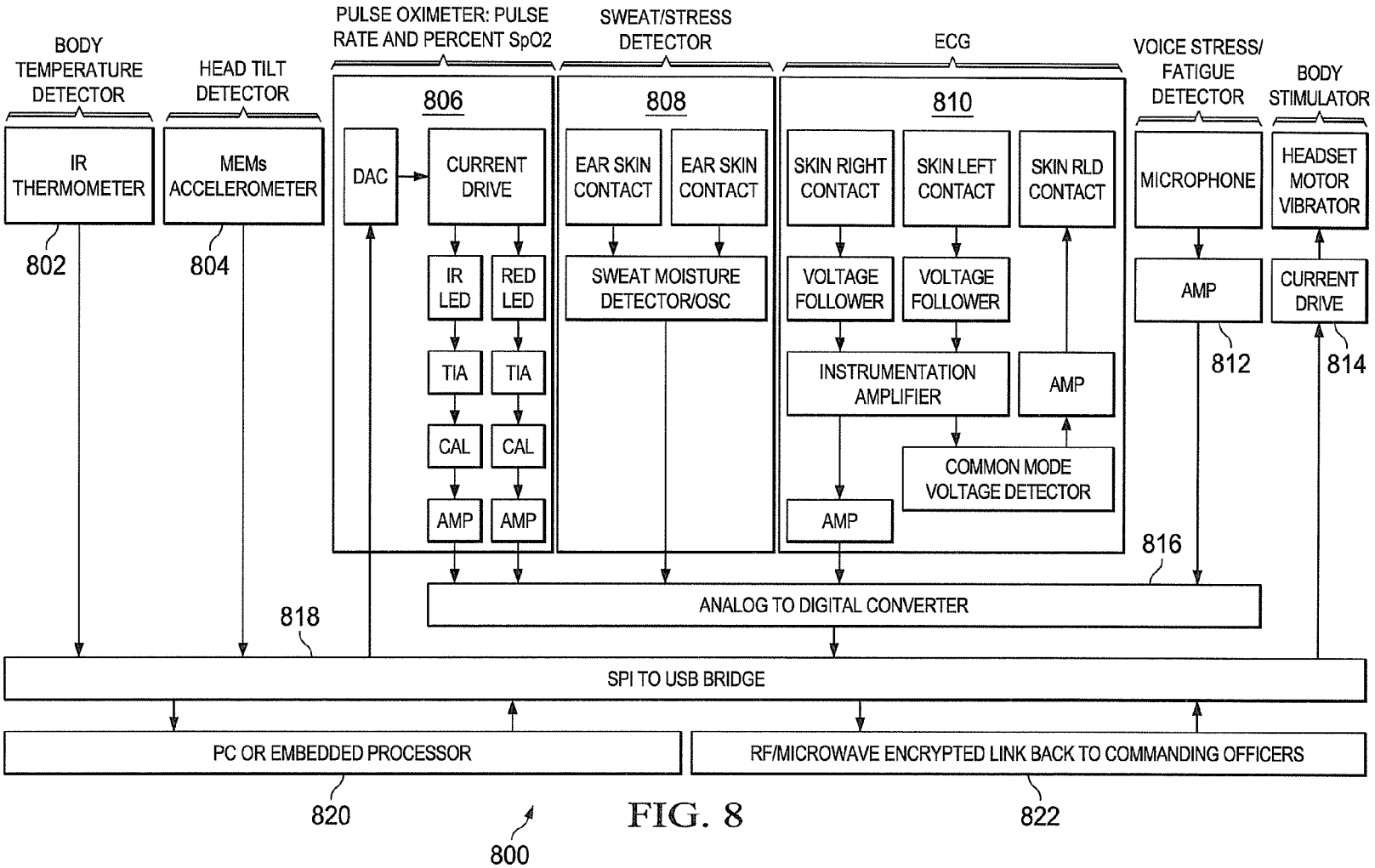

FIG. 8 illustrates a more detailed example implementation of the processing circuitry 600 and the control unit 700. As shown in FIG. 8, circuitry 800 includes an infrared temperature sensor 802 and a MEMS accelerometer 804. The circuitry 800 also includes a pulse oximeter 806, which is implemented using a digital-to-analog converter (DAC) that provides a signal to a current driver. The current driver provides drive current to infrared and red (or other visible) LEDs. Optical detectors are implemented using transimpedance amplifiers (TIAs), calibration units (CALs), and amplifiers (AMPs). The calibration units handle the presence of ambient light that may reach the optical detectors by subtracting the ambient light's signal from the LEDs' signals. A sweat and stress detector 808 is implemented using skin contacts near the operator's ear and a detector/oscillator. An EKG/ECG sensor 810 is implemented using right and left skin contacts, voltage followers, an instrumentation amplifier, and an amplifier. Right-leg guarding (RLD) is implemented in the sensor 810 using a common-mode voltage detector, an amplifier, and a skin RLD contact. A voice stress/fatigue detector 812 includes a microphone and an amplifier. A body stimulator 814 for providing biofeedback to an operator includes a current driver that drives a motor vibrator.

Information from various sensors is provided to an analog-to-digital converter (ADC) 816, which digitizes the information. Information exchange with various sensors and the ADC 816 occurs over a bus. In this example, a Serial Peripheral Interface (SPI) to Universal Serial Bus (USB) bridge 818 facilitates communication over the bus, although other types of bridges or communication links could be used. The information is provided to a computing device or embedded processor 820, which analyzes the information, determines a measure of the operator's awareness, and triggers biofeedback if necessary. A wireless interface 822 could also provide information (from the sensors or the computing device/embedded processor 820) to external devices or systems, such as a device used by an operator's supervisor.

Figure 9:
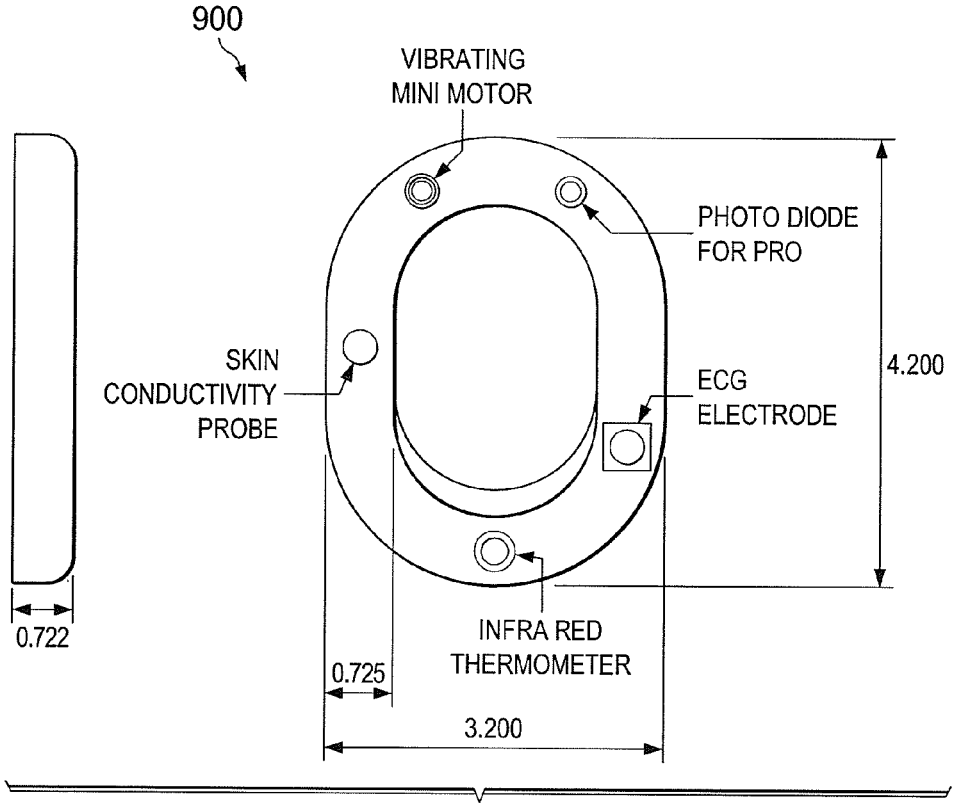

FIG. 9 illustrates an example ear cuff 900, which could be used with any of the headsets described above. As shown in FIG. 9, the ear cuff 900 includes an integrated vibrating motor and various sensors. As described above, the vibrating motor could be triggered to provide feedback to an operator, such as to help wake or focus an operator. The sensors could be positioned in the ear cuff 900 in any desired position. For example, as noted above, an EKG/ECG electrode could be placed near the bottom of the ear cuff 900, which helps to position the EKG/ECG electrode near an operator's artery when the headset is in use. In contrast, the position of a skin conductivity probe may not be critical, so it could be placed in any convenient location (such as in the rear portion of an ear cuff for placement behind the operator's ear).

Although FIGS. 6 through 9 illustrate examples of components in a system for monitoring the condition of an operator, various changes may be made to FIGS. 6 through 9. For example, while the diagrams in FIGS. 6 and 7 illustrate examples of a headset and a control unit, the functional division is for illustration only. Functions described as being performed in the headset could be performed in the control unit or vice versa. Also, the circuits shown in FIG. 8 could be replaced by other designs that perform the same or similar functions. In addition, the types and positions of the sensors in FIG. 9 are for illustration only.

Figure 10:
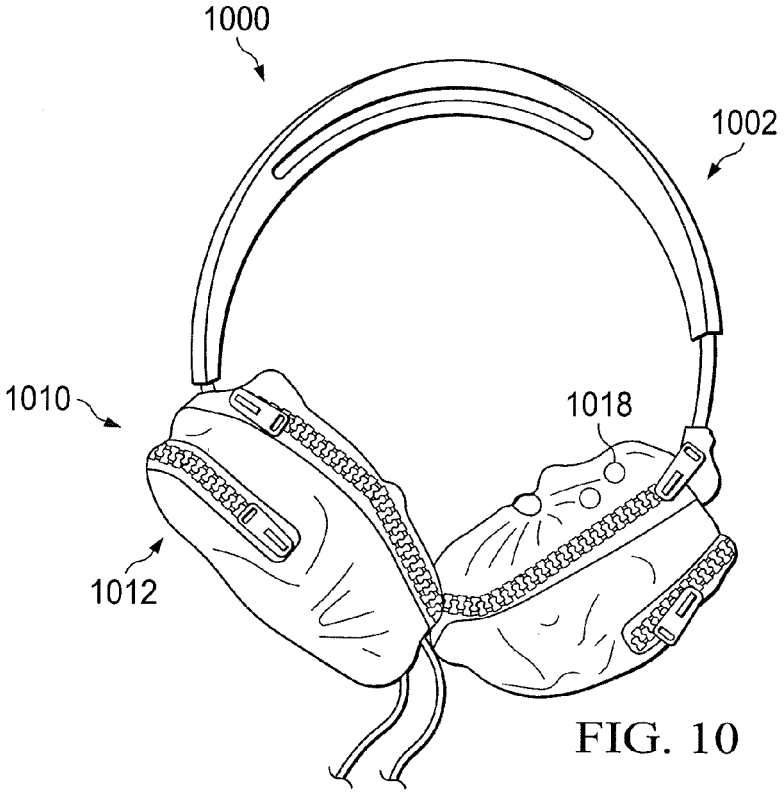
FIG. 10 illustrates another example system for monitoring the condition of an operator in accordance with this disclosure.

FIG. 10 illustrates another example system 1000 for monitoring the condition of an operator in accordance with this disclosure. As shown in FIG. 10, the system 1000 includes a headset 1002 having two speaker units 1010.

The speaker units 1010 are encased or otherwise protected by covers 1012. Each cover 1012 represents a structure that can be placed around at least part of a speaker unit. The covers 1012 can provide various functions, such as protection of the speaker units or sanitary protection for the headset. One or more of the covers 1012 here include at least one embedded sensor 1018, which could measure one or more physiological characteristics of an operator. Sensor measurements could be provided to a control unit (within or external to a cover 1012) via any suitable wired or wireless communications. Each cover 1012 could represent a temporary or more permanent cover for a speaker unit of a headset. While shown here as having zippers for securing a cover to a speaker unit, any other suitable connection mechanisms could be used. Also, each cover 1012 could be formed from any suitable material(s), such as e-textiles or some other fabric.

Although FIG. 10 illustrates another example of a system 1000 for monitoring the condition of an operator, various changes may be made to FIG. 10. For example, the headset 1002 could include any of the various features described above with respect to FIGS. 1 through 9. Also, the headset 1002 may or may not include a microphone unit, and the headset 1002 could include only one speaker unit.

Figure 11:
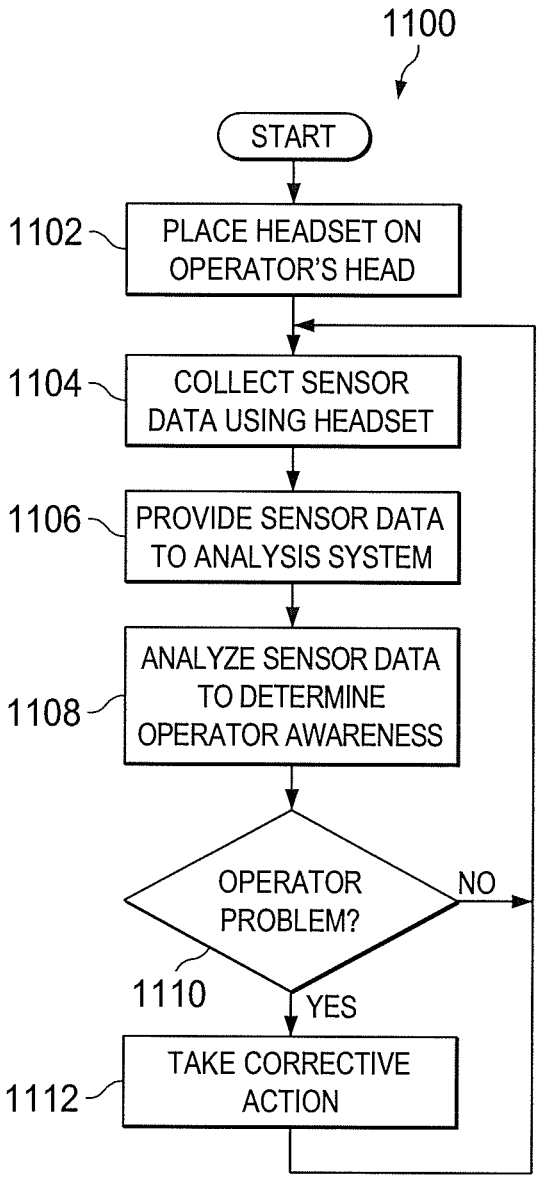
FIG. 11 illustrates an example method for monitoring the condition of an operator in accordance with this disclosure.

FIG. 11 illustrates an example method 1100 for monitoring the condition of an operator in accordance with this disclosure. As shown in FIG. 11, a headset is placed on an operator's head at step 1102. This could include, for example, placing any of the headsets described above on an operator's head. As part of this step, one or more sensors embedded within the headset can be placed near or actually make contact with the operator. This could include, for example, positioning the headset so that multiple pulse oximetry LEDs are in a position to illuminate the operator's skin. This could also include positioning the headset so that EKG/ECG electrodes are positioned near an operator's arteries and so that a skin conductivity probe contacts the operator's skin.

Sensor data is collected using the headset at step 1104. This could include, for example, sensors in the headset collecting information related to the operator's head tilt, heart rate, pulse oximetry, EKG/ECG, respiration, temperature, skin connectivity, blood pressure, or hydration. This could also include sensors in the headset collecting information related to the operator's environment, such as ambient noise. This could further include analyzing audio data from the operator to identify voice characteristics of the operator.

The sensor data is provided to an analysis system at step 1106 and is analyzed to determine a measure of the operator's awareness at step 1108. This could include, for example, providing the various sensor data to a decision-making engine. This could also include the decision-making engine performing data fusion to analyze the sensor data. As a particular example, the decision-making engine could analyze various characteristics of the operator and, for each characteristic, determine the likelihood that the operator is in some type of distress. The decision-making engine could then combine the likelihoods to determine an overall measure of the operator's awareness.

A determination is made whether the operator has a problem at step 1110. This could include, for example, the decision-making engine determining whether the overall measure of the operator's awareness is above or below at least one threshold value. If no problem is detected, the process can return to step 1104 to continue collecting and analyzing sensor data.

If a problem is detected, corrective action is taken at step 1112. This could include, for example, the decision-making engine triggering auditory, vibrational, or other biofeedback using the operator's headset or other device(s). This could also include the decision-making engine triggering a warning on the operator's computer screen or other display device. This could further include the decision-making engine triggering an alarm or warning message on other operators' devices or a supervisor's device. Any other or additional corrective action could be taken here. The process can return to step 1104 to continue collecting and analyzing sensor data.

Although FIG. 11 illustrates one example of a method 1100 for monitoring the condition of an operator, various changes may be made to FIG. 11. For example, while shown as a series of steps, various steps in FIG. 11 could overlap, occur in parallel, occur in a different order, or occur any number of times.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

one or more speaker units, each speaker unit configured to provide audio signals to an operator, each speaker unit comprising an ear cuff configured to contact the operator's head;

a support structure configured to secure the apparatus to the operator's head;

multiple sensors configured to measure (i), one or more physiological characteristics associated with the operator, (ii) one or more environmental characteristics surrounding the operator, and (iii) one or more operator behaviors, at least one of the sensors embedded within or attached to at least one ear cuff of at least one speaker unit, the sensors including an electrocardiography electrode embedded in or attached to a lower portion of at least one ear cuff so as to be in proximity to an artery of the operator when the at least one ear cuff is in contact with the operator's head; and at least one processing unit configured to (i) receive and analyze measurements associated with the one or more physiological characteristics, the one or more environmental characteristics, and the one or more operator behaviors and (ii) in response to the analyzed measurements, determine a measure of operator awareness associated with the operator and trigger feedback to the operator.

2. The apparatus of claim 1, wherein the sensors further include at east one biometric identifier configured to identify the operator using biometric data associated with the operator.

3. The apparatus of claim 1, wherein the sensors further include at least one skin conductivity probe embedded in or attached to a rear portion of at least one ear cuff.

4. The apparatus of claim 1, wherein the sensors further include multiple pulse oximetry light emitting diodes and photodetectors embedded in or attached to at least one ear cuff.

5. The apparatus of claim 1, wherein the sensors further include at least one of an accelerometer and a gyroscope configured to measure head tilt of the operator.

6. The apparatus of claim 1, wherein the sensors further include at least one temperature sensor embedded in or attached to at least one ear cuff

7. The apparatus of claim 1, wherein the at least one processing unit is further configured to analyze audio signals captured by a microphone unit to identify one or more of: respiration by the operator and at least one voice characteristic of the operator.

8. The apparatus of claim 1, further comprising:

a vibrating motor embedded within or attached to at least one ear cuff and configured to provide vibratory feedback to the operator.

9. The apparatus of claim 1, wherein the at least one processing unit is further configured to compare the measure of operator awareness to a threshold value, and provide the feedback to the operator if the measure of operator awareness violates the threshold value.

10. The apparatus of claim 1, further comprising:

a padded region configured to be positioned on top of the operator's head when the apparatus is worn by the operator; and a circuit board disposed within the padded region, the circuit board comprising at least one additional sensor.

11. A system comprising:

one or more speaker units, each speaker unit configured to provide audio signals to an operator, each speaker unit comprising an. ear cuff configured to contact the operator's head;

a support structure configured to secure the one or more speaker units to the operator's head;

multiple sensors configured to measure (i) one or more physiological characteristics associated with the operator, (ii) one or more environmental characteristics surrounding the operator, and (iii) one or more operator behaviors, at least one of the sensors embedded within or attached to at least one ear cuff of at least one speaker unit; and at least one processing configured to (i) receive and analyze measurements associated with the one or more physiological characteristics, the one or more environmental characteristics, and the one or more operator behaviors and (ii) in response to the analyzed measurements, determine a measure of operator awareness associated with the operator and trigger feedback to the operator.

12. The system of claim 11, wherein:

a control unit comprises the at least one processing unit and an active noise reduction processing unit; and the at least one processing unit is further configured to receive audio signals captured by a microphone unit in parallel with the active noise reduction processing unit.

13. The system of claim 12, wherein the control unit comprises a push-to-talk button.

14. The system of claim 11, wherein the at least one processing unit is further configured to analyze audio signals captured by a microphone unit to identify one or more of: respiration by the operator and at least one voice characteristic of the operator.

15. The system of claim 11, wherein the sensors further include:

at least one skin conductivity probe embedded in or attached to a rear portion of at least one ear cuff; and an electrocardiography electrode embedded in or attached to a lower portion of at least one ear cuff so as to be in proximity to an artery of the operator when the at least one ear cuff is in contact with the operator's head.

16. The system of claim 11, wherein the sensors further include at least one of:

multiple pulse oximetry light emitting diodes and photodetectors embedded in or attached to at least one ear cuff; and at least one temperature sensor embedded in or attached to at least one ear cuff.

17. The system of claim 11, wherein the sensors further include at least one of an accelerometer and a gyroscope configured to measure head tilt of the operator.

18. The system of claim 11, further comprising:

a transmitter or transceiver configured to provide the measurements of the one or more characteristics from the sensors to the at least one processing unit.

19. The system of claim 11, wherein the at least one processing unit is further configured to compare the measure of operator awareness to a threshold value and provide the feedback to the operator if the measure of operator awareness violates the threshold value.

20. A method comprising:

providing audio signals to an operator using one or more speaker units, each speaker unit comprising an ear cuff configured to contact the operator's head, wherein a support structure is configured to secure the one or more speaker units to the operator's head;

measuring (i) one or more physiological characteristics associated with the operator, (ii) one or more environmental characteristics surrounding the operator, and (iii) one or more operator behaviors using multiple sensors, at least one of the sensors embedded within or attached to at least one ear cuff of at least one speaker unit, the sensors including an electrocardiography electrode embedded in or attached to a lower portion of at least one ear cuff so as to be in proximity to an artery of the operator when the at least one ear cuff is in contact with the operator's head;

receiving and analyzing measurements associated with the one or more physiological characteristics, the one or more environmental characteristics, and the one or more operator behaviors; and in response to the analyzed measurements, determining a measure of operator awareness associated with the operator and triggering feedback to the operator.

21. The method of claim 20, further comprising:

comparing the measure of operator awareness to a threshold value; and taking corrective action if the measure of operator awareness violates the threshold value.

22. The method of claim 21, wherein taking corrective action comprises providing the feedback to the operator.

23. An apparatus comprising:

a cover configured to be placed over at least a portion of a speaker unit, the speaker unit configured to be secured to an operator's head, the cover comprising at least one sensor configured to measure (i) one or more physiological characteristics associated with the operator, (ii) one or more environmental characteristics surrounding the operator, and (iii) one or more operator behaviors, the at least one sensor embedded within or attached to the cover; and at least one processing unit configured to (i) receive and analyze measurements associated with the one or more physiological characteristics, the one or more environmental characteristics, and the one or more operator behaviors (ii) in response to the analyzed measurements, determine a measure of operator awareness associated with operator and trigger feedback to the operator.

* * * * *